US006614135B1

(12) United States Patent
Clapham

(10) Patent No.: US 6,614,135 B1
(45) Date of Patent: Sep. 2, 2003

(54) APPARATUS FOR GENERATING ELECTROMAGNETIC RADIATION DIRECTED AT CERTAIN TARGETS

(76) Inventor: Thomas Joseph Clapham, 2823 18th Ave. North, Minneapolis, MN (US) 55411

( * ) Notice: Subject to any disclaimer, the term of this patent is extended or adjusted under 35 U.S.C. 154(b) by 0 days.

(21) Appl. No.: 09/531,458

(22) Filed: Mar. 20, 2000

(51) Int. Cl.[7] ..... G01J 1/00
(52) U.S. Cl. ..... 307/106; 336/132; 250/503.1
(58) Field of Search ..... 307/106; 250/493.1, 250/496.1, 503.1; 336/30, 41, 132, 212

(56) References Cited

U.S. PATENT DOCUMENTS 4,912,742 A * 3/1990 Nath ..... 219/690
5,044,714 A * 9/1991 Taylor et al. ..... 385/5
5,053,672 A * 10/1991 Clapham ..... 310/334
5,150,067 A * 9/1992 McMillan ..... 315/39
5,293,527 A * 3/1994 Sutton et al. ..... 307/106
5,503,059 A * 4/1996 Pacholok ..... 89/1.11
5,608,403 A * 3/1997 Miller ..... 342/13
5,684,341 A * 11/1997 Steingroever ..... 363/34
6,396,213 B1 * 5/2002 Koloc ..... 315/111.21
6,450,454 B1 * 9/2002 Boz et al. ..... 244/158 R

FOREIGN PATENT DOCUMENTS

DE 3706385 A1 * 8/1988 ..... H05H/1/24
FR 2793973 A1 * 11/2000 ..... H04B/1/02

* cited by examiner

*Primary Examiner*—Brian Sircus
*Assistant Examiner*—Roberto J. Rios
(74) *Attorney, Agent, or Firm*—Herman H Bains

(57) ABSTRACT

An apparatus for generating electromagnetic pulses includes circuitry comprising an induction coil having a silver anode projecting into the coil. Moveable silver mass elements are adjustably mounted on the anode. The circuitry is immersed in liquid hydrogen and when energized produces electromagnetic pulses. If is believed that some of the anode material is consumed during the production of EMP converting the anode material into electromagnetic radiation energy. As the consumption continues the elongate anode assembly produces a composite wave form that equates to the size, shape and arrangement of the mass elements.

4 Claims, 1 Drawing Sheet

APPARATUS FOR GENERATING ELECTROMAGNETIC RADIATION DIRECTED AT CERTAIN TARGETS

FIELD OF THE INVENTION

This invention relates to an apparatus for generating controlled frequency electromagnetic pulses specifically designed to neutralize only certain military targets while leaving unaffected civilians and civilian utilities.

BACKGROUND OF THE INVENTION

Electromagnetic pulses have been generated by nuclear explosions in or above the earth's atmosphere. The nuclear explosion release high energy electromagnetic energy or gamma rays. In atmospheric detonations, the gamma rays or photons moving toward the earth penetrate a more dense region of the atmosphere and interact with air molecules to form 1-MeV Compton electrons and less energetic gamma rays which move in the same direction as the original gamma rays. The Compton electrons spiral about the geomagnetic lines as they slow down.

It is possible for electromagnetic pulses to directly interact with electronic systems causing electromagnetic pulses (EMP) signals internal to the structure. This may cause serious problems for electronics in metallic enclosures.

SUMMARY OF THE INVENTION

An object of this invention is to provide an apparatus for generating electromagnetic pulses which may be directed to disrupt electronic and electromechanical devices. In operation the generated EMPS are filtered to eliminate unwanted wave lengths to thereby selectively increase the effectiveness of the system.

DESCRIPTION OF THE PREFERRED EMBODIMENT

Figure 2:
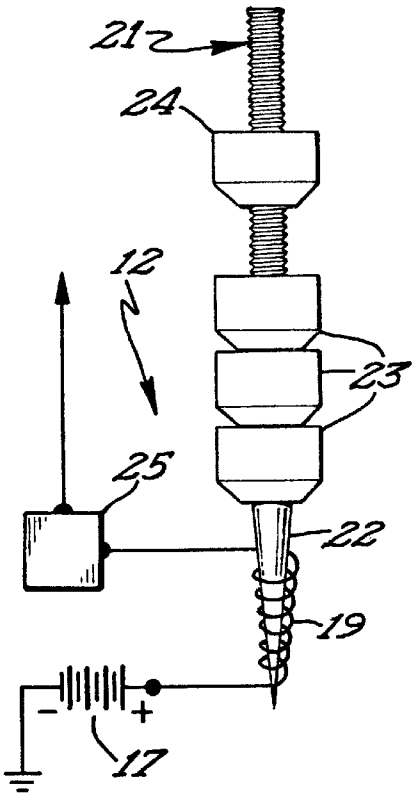
FIG. 2 is a diagrammatic view of the circuitry used in the apparatus.
Figure 1:
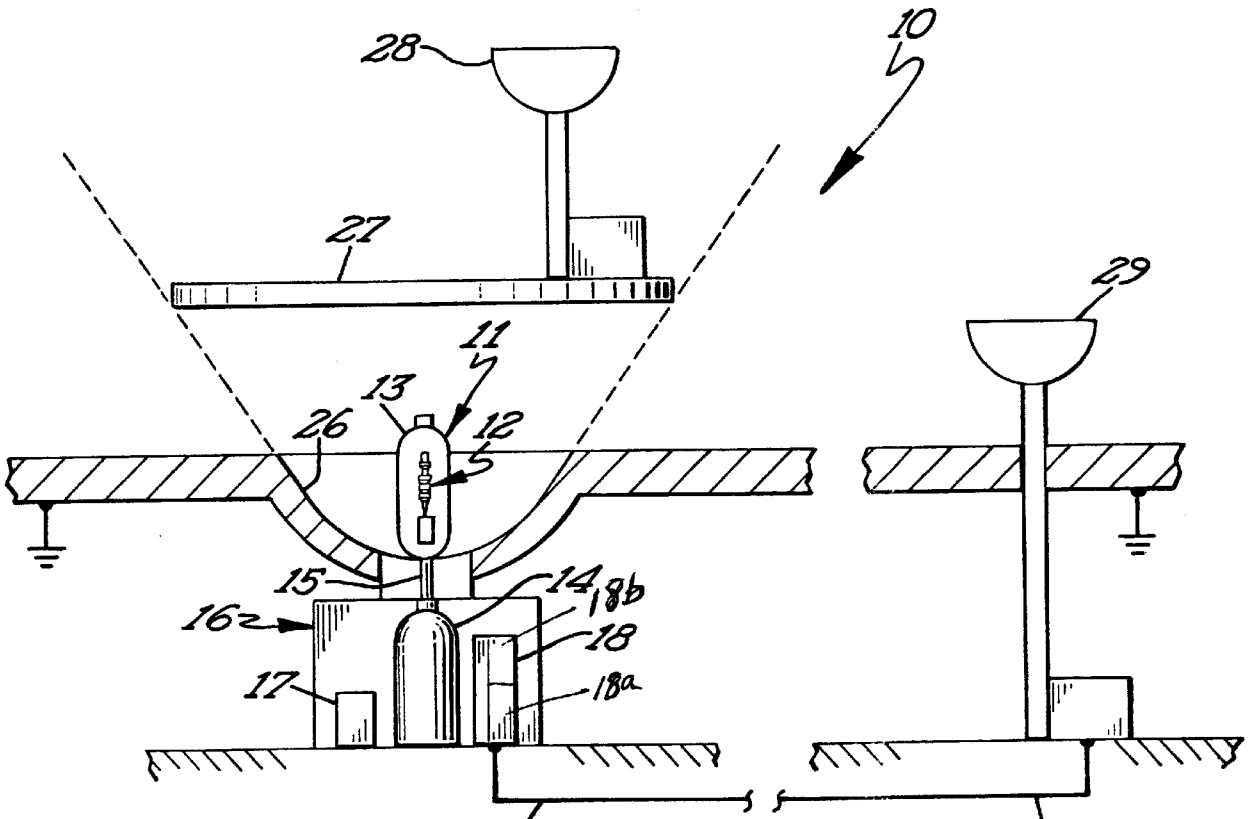
FIG. 1 is a diagrammatic view of the novel apparatus.

Referring now to the drawings and more particularly to FIG. 1, it will be seen that the apparatus for generating electromagnetic pulses (EMP) is diagrammatically illustrated and designated generally by the reference number 10. The apparatus includes an elongate threaded anode rod 21 formed of silver and provided with a tapered end portion 22. A plurality of silver mass elements 23 and an iron mass element 24 are threaded on the anode rod 21. A silicon mass element may be used in lieu of a silver mass element.

An thermally insulated container 13 containing a coolant, preferably liquid hydrogen, is provided and also contains the anode rod and mass elements. The liquid coolant is directed into the container 13 is positioned within a housing 16 which also contains a generator 17 for generating electric current.

One end portion of the elongate anode rod 21 and mass elements assembly projects into an induction coil 19. The relative positions, shapes, sizes and sequencing of the mass elements substantially influence and reflect the composite wave form of the generated EMP waves. The shape and size of the mass elements 23, 24 may therefore vary. A discharge condenser 25 is electrically connected to the inductor coil and when discharged will trigger generation of EMP waves from the anode rod and mass elements assembly.

A filter 27 is positioned in confronting relation with respect to a reflector 26 and filters the generated EMPS to thereby allow only the preferred wave lengths to clear the filter. The filter and reflector cooperate with the anode rod and mass elements (spacing positions, shape, size and sequencing) for producing EMPS allowing neutralization selectively of military targets only.

An antenna unit 28 is mounted on the filter 27. A scanning antenna 29 is electrically connected to the scanning and proximity computer 18 by an electrical conductor 30. The scanning and proximity computer with a radar system 18*a* having a grid dip system 18*b* for detecting electronic vulnerabilities known to exist in specific enemy targets to thereby assist in the identification of the targets. The generated EMPS can be coupled to systems of different topologies and cause significant problems. The coupling of EMP signals ($10^4$ to $10^8$ Hz) to electronic systems can cause disruption of the system.

However even if transmission onto circuits is inefficient $10^{-13}$ joules can upset some semi-conductor devices and $10^{-6}$ joules can cause damage. While many semi-conductor devices are hardened, there are some that are not hardened. By increasing the strength of the EMP signals, the destruction of most semi-conductor devices is achievable. Thus most targeted semi-conductor devices are susceptible to EMP signal whether land, water or airborne.

What is claimed is:

1. A device for producing and generating electromagnetic pulse signals for disrupting semi-conductor devices, comprising an electromagnetic pulse generating circuit including an inductor coil connected to a source of electric current, an elongate anode core projecting into said coil, said anode core formed of an inductive metal silver, a plurality of similar mass elements adjustably mounted on said anode core and being selectively adjustable along said anode core, said anode core and mass elements being formed of silver said electromagnetic pulse generating circuit being positioned in and cooled in liquid coolant, said electromagnetic pulse generating circuit being positioned in a transmission reflector for assisting transmission of the generated electromagnetic pulses, and a filter positioned in confronting relation to said reflector for filtering and selecting the desired frequency of the generated electromagnetic pulses.

2. The device as defined in claim 1 wherein said electromagnetic pulse generating circuit is positioned within a container containing coolant liquid hydrogen.

3. The device as defined in claim 2 wherein the shape, size, content, and spacing of the mass elements on said anode cove influence the wave form and frequency of the generated electromagnetic pulses.

4. The device as defined in claim 1 and a radar and grid dip system for pre-scanning and selectively determining desirable targets thereby increasing the efficiency of the system.

* * * * *